United States Patent [19]

Smet

[11] Patent Number: 4,823,888

[45] Date of Patent: Apr. 25, 1989

[54] APPARATUS FOR MAKING A SUBTERRANEAN TUNNEL

[76] Inventor: Nic H. W. Smet, Kasteelstraat 29, B - 2400 Mol, Belgium

[21] Appl. No.: 133,347

[22] Filed: Dec. 15, 1987

[30] Foreign Application Priority Data

Dec. 30, 1986 [BE] Belgium ..... 2/61145

[51] Int. Cl.[4] ..... E21B 7/08; E21B 10/60; E21B 47/024

[52] U.S. Cl. ..... 175/45; 175/61; 175/62; 175/67; 175/74

[58] Field of Search ..... 299/16, 17, 30, 81; 175/21, 67, 45, 100, 424, 73, 74, 61, 62; 405/138, 143, 184, 248

[56] References Cited

U.S. PATENT DOCUMENTS

| | | | |
|---|---|---|---|
| 2,783,972 | 3/1957 | Fehlmann | 175/67 X |
| 3,525,405 | 8/1970 | Coyne et al. | 175/45 X |
| 3,536,151 | 10/1970 | Aarup | 175/21 X |
| 4,396,073 | 8/1983 | Reichman et al. | 175/74 |
| 4,674,579 | 6/1987 | Geller et al. | 175/67 X |
| 4,714,118 | 12/1987 | Baker et al. | 175/67 X |

FOREIGN PATENT DOCUMENTS

| | | | |
|---|---|---|---|
| 3513194 | 6/1986 | Fed. Rep. of Germany | 405/184 |

*Primary Examiner*—Jerome W. Massie, IV
*Assistant Examiner*—David J. Bagnell
*Attorney, Agent, or Firm*—Stevens, Davis, Miller & Mosher

[57] ABSTRACT

The invention provides apparatus for making a tunnel. A flexible tube connects to a head consisting of a body and a nose mounted for movement thereon. The nose has an abutment face adjustable in position relative to said body, and carries a nozzle. The nose may be a bevelled cylinder which may be rotatable relatively to the body by a steering mechanism or be conical and be tiltable by jacks operable from above the ground.

10 Claims, 4 Drawing Sheets

APPARATUS FOR MAKING A SUBTERRANEAN TUNNEL

BACKGROUND OF THE INVENTION

This invention relates to an apparatus for making a subterranean tunnel, comprising a head having in its turn a body and a nose mounted thereon and provided on at least one side with an abutment face which may make an angle with the geometrical axis of the body, at least one nozzle mounted on the nose and directed away from said body and a duct for fluid under pressure connected to said nozzle.

Apparatuses of this kind are used among other things for making or boring tunnels extending substantially in horizontal direction. Such tunnels serve for the installation of so-called utility piping.

The fluid under pressure injected through the nozzle loosens the soil in front of the nose, and the direction of advance of the head in the ground and hence the direction of the tunnel bored depend substantially on the direction of the abutment face relative to the body.

The term "boring" as used herein is therefore to be construed in the broadest sense, and does not necessarily connote a rotating movement e.g. of a boring tool. Boring can also mean the squirting away and/or the displacement of the soil.

The abutment face is necessary for orienting the head somewhere in the ground, for it happens that certain obstacles, such as a watercourse, have to be avoided.

In a known apparatus for subterraneous boring, the nose, having an abutment face inclined to the axis of the body at one side only is integral with said body, and rods are provided for rotating the body and the nose around the longitudinal axis.

When during the advancement of the boring head and the injection of fluid under pressure, said head is rotated, it is displaced straight on in the same direction wherein it is being pushed. When during pushing, the boring head is not rotated, however, the head pushes itself off by means of the abutment face relatively to the ground and deviates from the pushing direction in the sense away from said abutment face. When the abutment face is at the underside, the boring head moves upwardly.

Not only does this known apparatus fail to provide for accurate steering, but it also restricts the possibilities of using the apparatus. Thus no rectilinear boring is possible without rotating the boring head. It is not possible to deviate from this boring direction with a rotating head or nose. Also the necessity to use rigid rods for rotating the head constitutes an impediment to the choice of the means for advancing the head. This cannot be effected e.g. with flexible hoses or tubes.

It is an object of the present invention to remove these drawbacks and to provide an apparatus of the above described type, wherein the head can be steered in a very simple and accurate manner and which offers an ample range of applications and wherein, for one thing, the boring direction does not depend on whether the head is or is not rotated during the driving of the boring head.

THE PRESENT INVENTION

To that end, the nose is mounted for movement relative to the body in such a manner that the abutment face is adjustable in position relative to the body and there is mounted in the head a remote controlled steering mechanism for so moving the nose relatively to the body that the abutment face is adjusted in position relative to the body.

An adjustment of the position of the abutment face relative to the body means an adjustment of the direction of displacement of the head. During boring, the head is not rotated. In certain cases, the tip of the nose is rotatable relatively to the rest of the nose but this is not necessary for most applications.

In a particular embodiment of the present invention, the steering mechanism includes at least one jack.

In a first important embodiment of the present invention, the nose is mounted on the body for tilting movement and the steering mechanism includes means for tilting the nose relatively to the body.

Preferably, the nose is tiltable omnidirectionally relatively to the body.

The nose may be connected to the body through a ball joint

Preferably, the nose is also conical, so that the abutment face is formed all around, on all sides.

In a second important embodiment of the present invention the nose is mounted on the body for rotation around the geometrical axis of said body. The nose is asymmetrical relatively to said axis and the steering mechanism includes means for rotating the nose relatively to the body.

Effectively the nose is hollow and the means for rotating the nose relatively to the body include an operating member arranged in the hollow nose and in the body for movement in longitudinal direction of said body but not being rotatable with the outside of said operating member and the inside of the hollow nose being provided with a coacting embossment so that the linear movement of the operating member relative to the body is converted into a rotation of the nose relative to the body, while the means for rotating the nose include means for moving said operating member linearly relatively to the body.

In a preferred embodiment of the present invention, the apparatus comprises a spatial compass mounted in the head, said head including a piece of magnetic material surrounding the compass, a reading device mounted on said compass, and a display device arranged to be disposed above the ground for communication with said reading device.

In this embodiment, the boring direction can be monitored highly accurately from above the ground. Thus the correct location of the head under the ground can be monitored if desired, by means of a transmitter mounted on the head, which transmits to the soil surface and a receiver mounted above the ground.

Other features and advantages of the present invention will become apparent from the following description of an apparatus for making a subterranean tunnel according to the present invention; this description is given by way of example only and is not intended to restrict the invention in any way; the reference numerals relate to the accompanying drawings.

BRIEF DESCRIPTION OF THE DRAWINGS

In the different figures, the same reference numerals refer to the same elements.

DESCRIPTION OF THE PREFERRED EMBODIMENTS

Figure 1:
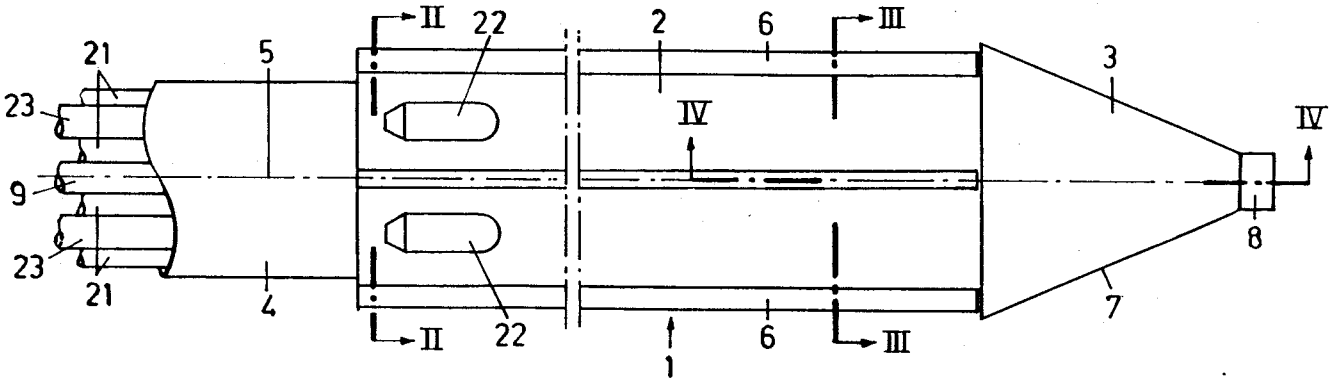
FIG. 1 is a side-elevational view of a part of an apparatus for making a subterranean tunnel according to the present invention.
Figure 2:
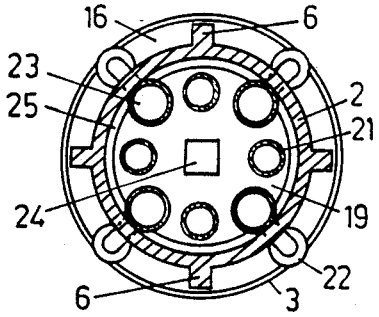
FIG. 2 is a cross-sectional view on the line II—II of FIG. 1.
Figure 3:
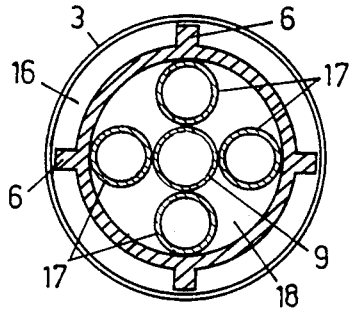
FIG. 3 is a cross-sectional view on the line III—III of FIG. 1.

The apparatus for making a tunnel as shown in the figures comprises a head generally indicated at 1, consisting essentially of a body 2 and a nose 3 connected thereto. The body 2 is connected to a round flexible steel tube 4 which is unwound from a reel arranged above the ground which, for the sake of simplicity, is not shown in the drawings.

The body 2 is an elongate cylinder having four ribs 6 distributed uniformly over its circumference and extending parallel to its longitudinal axis 5.

The nose 3 is mounted for movement on the end of body 2 distal from the flexible tube 4 and is provided with an abutment face 7 inclined to longitudinal axis 5.

On the tip of nose 3 there is mounted a nozzle 8 connected to a duct 9 for fluid under pressure extending through body 2 and flexible tube 4 and connected above the ground to a source of fluid under pressure which for the sake of simplicity is not shown in the drawings.

In head 1 there is mounted a steering mechanism 10 operable from above the ground for moving the nose 3 relatively to body 2, thereby adjusting the position of abutment face 7 relative to longitudinal axis 5.

In the embodiment shown in FIGS. 1–4, nose 3 is conical so that abutment face 7 extends over the entire nose circumference.

Nozzle 8, which may be either stationary or rotary, is mounted on the tip of the cone and projects slightly beyond the nose 3.

During rectilinear boring in the same direction, nose 3 is situated symmetrically relating to longitudinal axis 5 and hence the axis of the conical abutment face 7 coincides with the longitudinal axis of body 2.

For adjusting the position of the conical abutment face 7 relative to body 2, nose 3 is mounted for omnidirectional tilting movement through a small angle relative to body 2 by means of a ball joint 11.

Said ball joint 11 includes a spherical portion 12 surrounding a tube 13 mounted in the nose and to one end of which nozzle 8 is connected. The other end of said tube 13 is connected through a flexible duct 14 with the above ducts 9 for fluid under pressure. The spherical portion 12 is mounted in a bearing 15 secured within the hollow nose 3 to one end of body 2.

The largest diameter of the conical nose 3 is slightly larger than the diameter of the cylinder of body 2 so that the entire nose can tilt around the ball joint 11 relatively to said body 2.

Between the edge of nose 3 situated at the larger end and the outer circumference of the front end of the cylinder of body 2 there is provided an elastic seal 16.

The steering mechanism 10 is constituted by means for tilting the nose around the ball joint 11. These means include four hydraulic jacks 17 whose stationary portion is mounted between two transverse walls 18, 19 fixedly mounted in the body, The movable portion of said four jacks 17 co-operates with a thrust plate 20 secured to one end of tube 13 located proximal to body 2 relatively to ball joint 11.

The four finger-shaped movable portions of the four jacks 17 are distributed uniformly around longitudinal axis 5. Hydraulic jacks 17 are connected to hydraulic ducts 21 extending through body 2 and flexible tube 4 to above the ground. An operating mechanism, not shown, ensures the energization of jacks 17. These jacks allow the unit formed by nose 3, nozzle 8, tube 13, spherical portion 12 and thrust plate 20 to be tilted omnidirectionally in bearing 15 in a very accurate manner, so that the inclination of the geometrical axis of the conical nose 3 can be accurately adjusted with respect to the longitudinal axis 5 of body 2.

Such an adjustment of nose 3 relative to body 2 results in a change in position of conical abutment face 7 relative to body 2. As soon as the axis of symmetry of nose 3 is no longer co-extensive with longitudinal axis 5, this nose will push itself off the soil more at one side of said axis than at the other side, so that the nose and hence the entire head 1 will be displaced in a direction out of alignment with longitudinal axis 5. Nose 3 will describe an arc that is curved in the sense wherein the axis of symmetry of nose 3 deviates in respect of longitudinal axis 5 as long as said axis of symmetry is not co-extensive with longitudinal axis 5.

Head 1 is advanced by means of nozzles 22 mounted on the outside of body 2 and oriented away from nose 3. Said nozzles 22 are connected to a source of fluid under pressure, not shown, by means of ducts 23 extending through body 2 and flexible tube 4 to above the ground, which fluid source may be the same as the fluid source to which nozzle 8 is connected.

Possibly, one or more further nozzles may be mounted on body 2, which are oriented in the direction of nose 3 and are likewise connected through ducts to a source of fluid under pressure by means of these latter nozzles. Head 1 can be displaced rearwardly.

In front of nose 3, the soil is squirted away by means of nozzle 8, fed with fluid at a pressure of at least 250 $kg/cm^2$ and at a rate of between 5 and 20 l/min.

The direction in which head 1 is being displaced can be read above the ground by means of a spatial compass 24 mounted in body 2 within a ring 25 of non-magnetic material. Mounted on said compass 24 is a reading device 26 transmitting signals to an aboveground display device not shown for the sake of simplicity. Within the hollow nose 3 there is mounted a transmitter 27 transmitting to the surface. The correct location of head 1 under the ground can be determined by means of an aboveground receiver, likewise not shown.

Within hollow nose 3, there is also mounted an X-ray transceiver 28 transmitting rays in the forward direction of nose 3 along a distance of maximally 25 cm. These rays are reflected in the event of an obstacle and a signal from the reflected rays is transmitted to an aboveground monitor by the X-ray transceiver.

Figure 5:
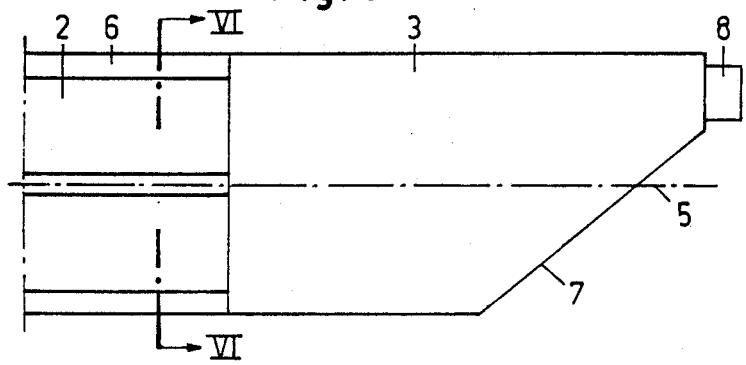
FIG. 5 is a side-elevational view similar to that of FIG. 1 but showing the front part of the head only and relating to a different embodiment of the present invention.
Figure 6:
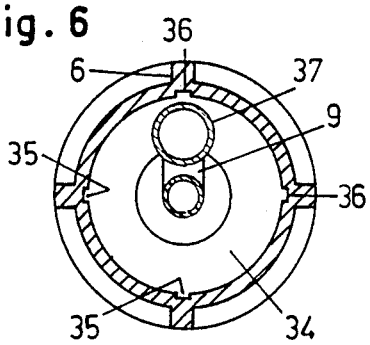
FIG. 6 is a cross-sectional view on the line VI—VI of FIG. 5.
Figure 7:
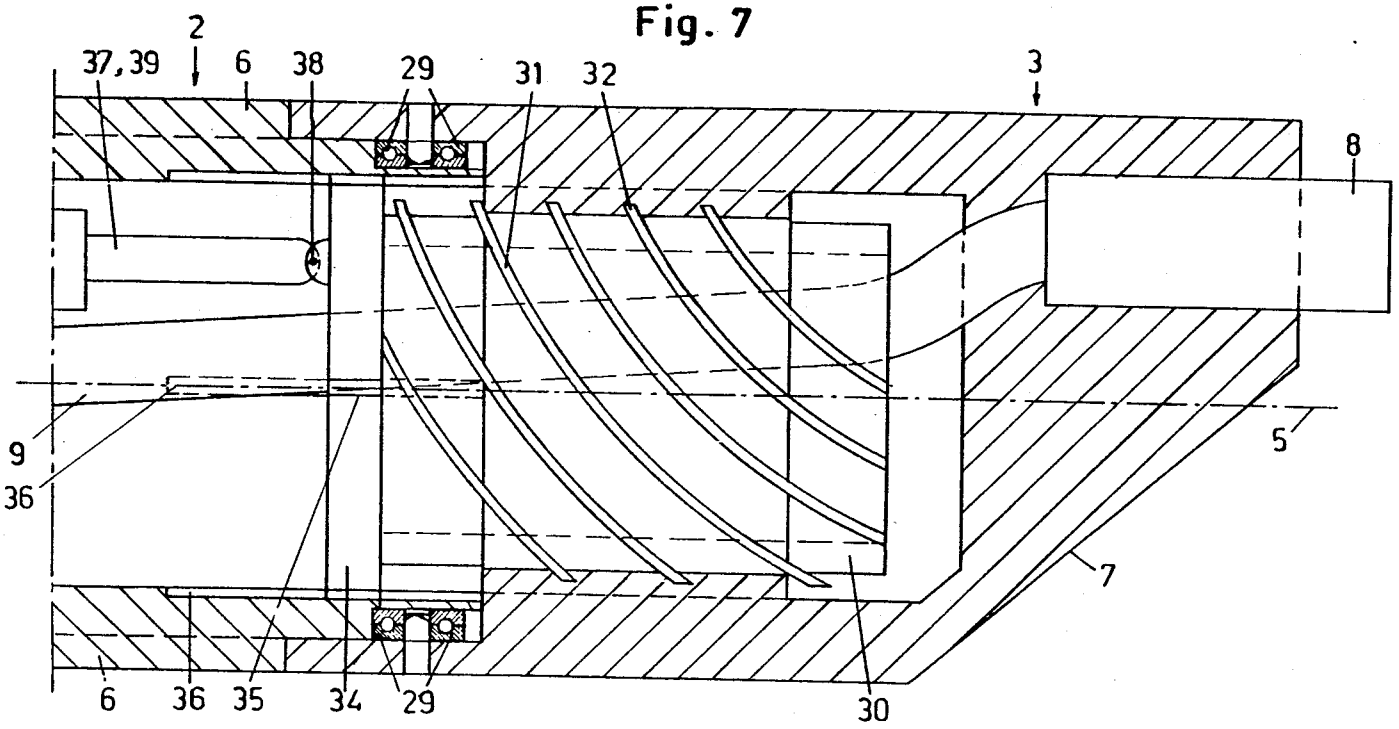
FIG. 7 is a vertical cross-sectional view of the part of the boring head of FIG. 6 but on an enlarged scale.

In the embodiment shown in FIGS. 5–7, nose 3, instead of being tiltably rotatable around longitudinal axis 5 of body 2, is secured to said body, with the nose 3 being, moreover, symmetrical relative to said longitudinal axis 5.

The nose is actually formed by a cylinder whose outside diameter corresponds with the outside diameter of body 2 and whose axis is co-extensive with longitudinal axis 5 of body 2, but whose front end, i.e. the end remote from body 2, is partly bevelled by a face inclined to the above axes, said face therefore forming the abutment face 7.

Nozzle 8 is located in the centre of the transverse end face of nose 3 and therefore has an eccentric position relative to longitudinal axis 5.

Nose 3 has its opposite end mounted for rotation on the front end of the cylindrical portion of body 2 by means of ball bearings 29, which are resistant to both compressive and tensile loads.

Within hollow nose 3 there is mounted a hollow operating member 30 having an external thread 31 coacting with an internal thread 32 provided within the inside of nose 3.

The duct 9 connected to nozzle 8 extends through said hollow operating member 30.

Within body 2, the portion with thread 31 connects to a ring 34 provided exteriorly with four lugs 35 distributed uniformly over its circumference, said lugs extending slidably into grooves 36 within the inside of body 2 and extending parallel to longitudinal axis 5.

As a result, a possible rotation of the helical operating member is prevented. Said operating member 30 can only be reciprocated in the direction of longitudinal axis 5, which sliding movement produces a rotation of nose 3 relative to body 2 in a sense depending on the linear sense of displacement of member 30.

Said linear displacement of operating member 30 is produced by a hydraulic jack 37 whose stationary portion is mounted within body 2 and whose mobile portion is connected to ring 34 through a pin 38.

Jack 37 is connected to an hydraulic duct 39 extending through body 2 and flexible tube 4 to above the ground and through an operable valve, is connected to a source of fluid underpressure. Neither this source nor this valve are shown for the sake of simplicity.

The position of nose 3 determines the inclination of abutment face 7 in the ground. During subterranean boring, nose 3 pushes itself off the soil by means of abutment face 7, whose inclination and location under the ground depend on the position of nose 3 relative to body 2.

In this manner, it is possible to determine the direction wherein nose 3 and hence the entire head 1 penetrates into the soil.

Figure 4:
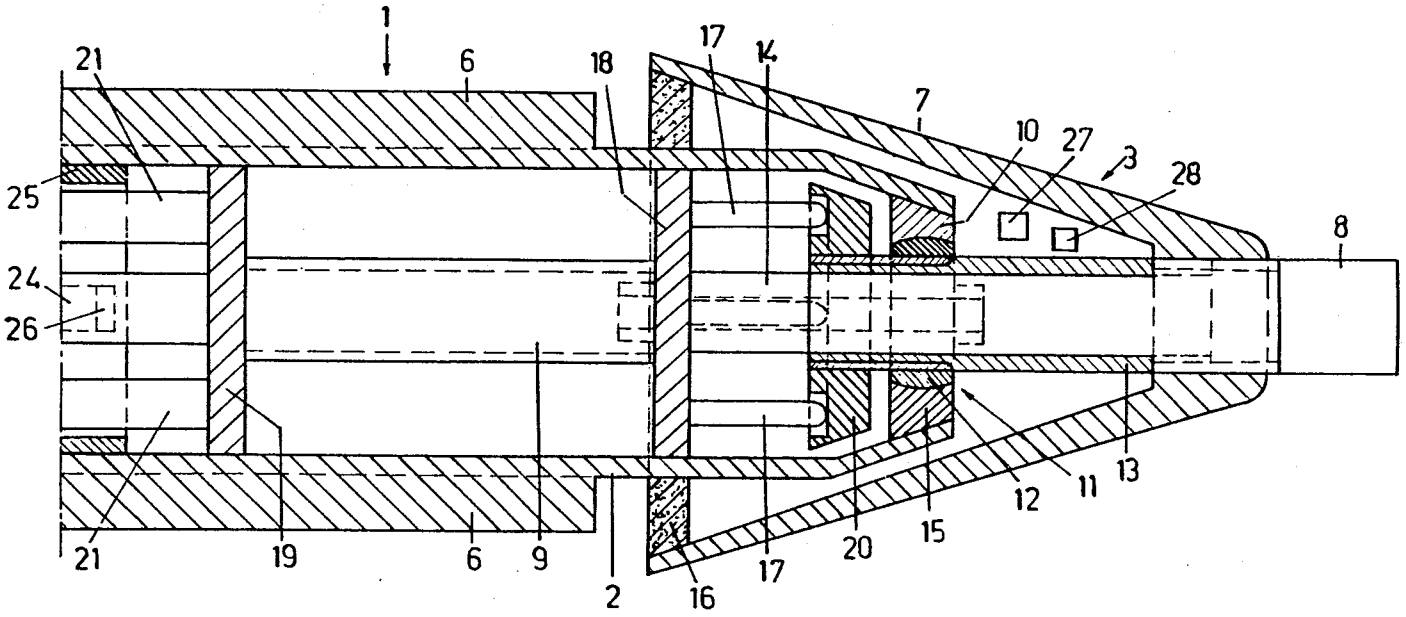
FIG. 4 is a cross-sectional view on the line IV—IV of FIG. 1 but on an enlarged scale.

This penetration into the soil is effected in the same manner as in the embodiment shown in FIGS. 1 and 4 by means of nozzles mounted on the body. In this embodiment, shown in FIGS. 5–7, too, a compass or transmitters can be mounted within head 1, as in the embodiment shown in FIGS. 1–4.

Both embodiments allow the highly accurate orientation of head 1 under the ground. The change in direction i commanded above the ground but is effected by a steering mechanism mounted within head 1. Head 1 can be mounted either on a set of rigid tubes or a flexible tube 4, and such set or such flexible tube need not be rotated in order to adjust the direction of the head.

Irrespective of a possible rotation of the head so as to change the boring direction, this head should not be rotated during boring. The nozzle mounted on the head, on the other hand, ma be rotatable though, as possible also the tip of the nose could be rotatable relatively to the rest as well.

The invention is by no means restricted to the embodiments described above, and many alterations are possible in the embodiments described without departing from the scope of the present invention, among other things as regards shape, composition arrangement and number of the parts used for the realization of the present invention.

In particular, the body of the head need not necessarily be an independent part of the rest of the duct on which the head is mounted. This body may be formed by a possible reinforced end of the flexible tube or of a possible rigid tube replacing this flexible tube.

The shape of the nose need not necessarily be as described in the above either. It is sufficient that at least a part of the exterior of this nose forms an abutment face which, during the advancement of the head, pushes itself off the soil, thereby affecting the direction wherein the nose is being displaced under the ground.

The jacks need not necessarily be hydraulic jacks. These may alternatively be mechanical or electrical jacks.

A pressure sensor can be mounted within the head. This may be an air pressure sensor by means of which in dry terrain the depth at which the head is located can be gauged and/or a water pressure sensor gauging the depth under water during drilling under water.

I claim:

1. An apparatus for, making a subterranean tunnel, comprising:

a head which includes:

a body having a geometrical axis and a front end, and a nose mounted on the front end of the body for rotation about the geometrical axis of said body and being asymmetrical relatively to the geometrical axis and having at one side an abutment face adapted to make an angle with the geometrical axis of said body, at least one nozzle mounted on the nose and oriented away from the body, a duct for fluid under pressure connected to said nozzle, and a remote-controlled steering mechanism mounted in the head and including means for rotating the nose relatively to the body so that the position of the abutment face of the nose relative to the body can be adjusted by rotation of the nose.

2. An apparatus as claimed in claim 1, wherein the nose has the shape of a cylinder whose one end is at least partly bevelled, with the bevel forming the abutment face.

3. An apparatus as claimed in claim 2, wherein the nozzle is located in the centre of a non-bevelled portion of the end of the nose.

4. An apparatus for making a tunnel underground, comprising a head including:

a body having a geometrical axis and a hollow nose which is mounted on the body for rotation about the geometrical axis of said body and being asymmetrical relatively to the geometrical axis, and having at one end an abutment face adapted to be at an angle to the geometrical axis of the body and having an inner surface provided with an embossment, at least one nozzle mounted on the nose and oriented away from the body, a duct for fluid under pressure connected with said nozzle, an operating member arranged within the hollow nose and within the body, movable longitudinally of said body but not being rotatable, said operating member having an outside surface provided with an embossment coacting with the embossment of the hollow nose in such a manner that the linear displacement of the operating member relative to the body is converted into a rotation of the nose relative to the body, and a remote-controlled steering mechanism mounted within the head and including means for displacing the operating member, for adjusting the position of the abutment face of the nose relative to the head by linear displacement of the operating member.

5. An apparatus as claimed in claim 4, wherein the embossment on the operating member is an external thread and the embossment on the nose coacting therewith is an internal thread.

6. An apparatus as claimed in claim 4, wherein said body defines guides in the body for the operating member so as to prevent rotation of said member relative to said body.

7. An apparatus as claimed in claim 4, wherein the means for the linear displacement of the operating member relative to the body include a jack.

8. An apparatus as claimed in claim 4, further comprising a spatial compass mounted in the head, said head including a piece of non-magnetic material surrounding the compass and a reading device mounted on the compass, and a display device arranged above the ground and communicating with the reading device.

9. An apparatus as claimed in claim 4, further comprising a transmitter mounted in the head and adapted to transmit signals to the ground surface.

10. An apparatus as claimed in claim 4, further comprising an X-ray transceiver mounted in the head and adapted to transmit X-rays in the direction of displacement of the head, said transceiver being connected to an above ground monitor.

* * * * *